US011391178B2

(12) United States Patent
Metge et al.

(10) Patent No.: US 11,391,178 B2
(45) Date of Patent: Jul. 19, 2022

(54) ELEMENT FOR DISTRIBUTING A COOLING FLUID AND ASSOCIATED TURBINE RING ASSEMBLY

(71) Applicant: SAFRAN AIRCRAFT ENGINES, Paris (FR)

(72) Inventors: Pierre Jean-Baptiste Metge, Moissy-Cramayel (FR); Sébastien Serge Francis Congratel, Moissy-Cramayel (FR); Lucien Henri Jacques Quennehen, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 44 days.

(21) Appl. No.: 16/756,736

(22) PCT Filed: Oct. 16, 2018

(86) PCT No.: PCT/FR2018/052577
§ 371 (c)(1),
(2) Date: Apr. 16, 2020

(87) PCT Pub. No.: WO2019/077265
PCT Pub. Date: Apr. 25, 2019

(65) Prior Publication Data

US 2021/0189905 A1 Jun. 24, 2021

(30) Foreign Application Priority Data

Oct. 19, 2017 (FR) ..... 1759843

(51) Int. Cl.
*F01D 25/14* (2006.01)
*F01D 25/12* (2006.01)
*F01D 25/24* (2006.01)

(52) U.S. Cl.
CPC ..... *F01D 25/14* (2013.01); *F01D 25/12* (2013.01); *F01D 25/246* (2013.01);
(Continued)

(58) Field of Classification Search
CPC ..... F01D 25/14; F01D 25/12
See application file for complete search history.

(56) References Cited

U.S. PATENT DOCUMENTS 4,187,054 A 2/1980 Auxier et al.
5,391,052 A 2/1995 Correia et al.
(Continued)

FOREIGN PATENT DOCUMENTS

CN 102686832 A 9/2012
CN 103459778 A 12/2013
(Continued)

OTHER PUBLICATIONS

International Search Report as issued in International Patent Application No. PCT/FR2018/052577, dated Jan. 29, 2019.
(Continued)

*Primary Examiner* — Ninh H. Nguyen
*Assistant Examiner* — John S Hunter, Jr.
(74) *Attorney, Agent, or Firm* — Pillsbury Winthrop Shaw Pittman LLP

(57) ABSTRACT

A cooling fluid distribution element intended to be fixed to a support structure for supplying cooling fluid to a wall to be cooled, typically a turbine ring sector, facing it, the distribution element including a body defining a cooling fluid distribution internal volume and a multi-perforated plate which delimits this internal volume and includes a plurality of outlet through-perforations which put the internal volume into communication with the turbine ring sector, the distribution element further including an inlet orifice opening into the cooling fluid distribution internal volume, which internal
(Continued)

volume includes directional fins for directing this cooling fluid from this inlet orifice to the outlet through-perforations.

8 Claims, 2 Drawing Sheets

(52) U.S. Cl.
CPC ..... *F05D 2220/30* (2013.01); *F05D 2240/11* (2013.01); *F05D 2240/14* (2013.01); *F05D 2260/201* (2013.01); *F05D 2300/6033* (2013.01)

(56) References Cited

U.S. PATENT DOCUMENTS

| | | | |
|---|---|---|---|
| 9,643,281 | B1 | 5/2017 | Memmen et al. |
| 2005/0129499 | A1 | 6/2005 | Morris et al. |
| 2012/0027572 | A1 | 2/2012 | Denece et al. |

FOREIGN PATENT DOCUMENTS

| | | | |
|---|---|---|---|
| CN | 103597170 | A | 2/2014 |
| CN | 106545365 | A | 3/2017 |
| DE | 102 17 257 | A1 | 4/2003 |
| EP | 1 219 788 | A2 | 7/2002 |
| WO | WO 2006/136755 | A2 | 12/2006 |

OTHER PUBLICATIONS

First Office Action as issued in Chinese Patent Application No. 201880065186.5, dated Apr. 27, 2022.

ELEMENT FOR DISTRIBUTING A COOLING FLUID AND ASSOCIATED TURBINE RING ASSEMBLY

CROSS-REFERENCE TO RELATED APPLICATIONS

This application is the U.S. National Stage of PCT/FR2018/052577, filed Oct. 16, 2018, which in turn claims priority to French patent application number 1759843 filed Oct. 19, 2017. The content of these applications are incorporated herein by reference in their entireties.

BACKGROUND OF THE INVENTION

The invention relates to a turbine ring assembly comprising a plurality of ring sectors made of ceramic matrix composite material (CMC material) or of metal material and relates more particularly to a cooling fluid distribution element.

The field of application of the invention is in particular that of aeronautical gas turbine engines. The invention is however applicable to other turbomachines, for example industrial turbines.

In aeronautical gas turbine engines, the improvement of the efficiency and the reduction of some polluting emissions lead to a search for operation at increasingly higher temperatures. In the case of entirely metallic turbine ring assemblies, it is necessary to cool all the elements of the assembly and particularly the turbine ring which is subjected to very hot streams. The cooling of a metal turbine ring requires the use of a large amount of cooling fluid, typically cooling air, which has a significant impact on the performance of the engine since the used cooling stream is taken from the main stream of the engine.

The use of ring sectors made of CMC material has been proposed in order to limit the ventilation required for cooling the turbine ring and thus increase the performance of the engine.

However, even if CMC ring sectors are used, it is still necessary to use a significant amount of cooling fluid. The turbine ring is, indeed, confronted with a hot source (the flowpath in which the hot gas stream flows) and a cold source (the cavity delimited by the ring and the casing, hereafter referred to as "ring cavity"). The ring cavity must be at a pressure higher than that of the flowpath in order to prevent gas coming from the flowpath from going up in this cavity and burning the metal parts. This overpressure is obtained by taking "cold" fluid at the compressor, which has not passed through the combustion chamber, and by conveying it to the ring cavity. Maintaining such an overpressure therefore makes it impossible to completely cut off the supply of "cold" fluid to the ring cavity.

In addition, studies conducted by the Applicant have shown that a ring, made of CMC or metal material, cooled by known cooling systems can have penalizing thermal gradients that generate unfavorable mechanical stresses. In addition, the cooling technologies used for a metal ring may not be easily transposable to a ring made of CMC material.

Whatever the nature of the material implemented for the ring sectors, it would therefore be desirable to improve the existing cooling systems in order to limit the unfavorable thermal gradients in the cooled ring sectors and therefore the generation of unfavorable stresses. It would be furthermore desirable to improve the existing cooling systems in order to optimize the amount of cooling fluid actually used for cooling the ring, in particular by limiting the cooling fluid leaks.

The invention aims specifically to meet the aforementioned needs.

OBJECT AND SUMMARY OF THE DE INVENTION

To this end, the invention proposes a cooling fluid distribution element intended to be fixed to a support structure for supplying cooling fluid to a wall to be cooled facing it, said distribution element comprising a body defining a cooling fluid distribution internal volume and a multi-perforated plate which delimits this internal volume and comprises a plurality of outlet through-perforations which put said cooling fluid distribution internal volume into communication with said wall to be cooled, the distribution element further comprising an inlet orifice opening into said cooling fluid distribution internal volume, characterized in that said cooling fluid distribution internal volume includes directional fins disposed substantially equidistant from said inlet orifice and said multi-perforated plate, for directing the cooling fluid from said inlet orifice to said outlet through-perforations.

The implementation, for each ring sector, of a cooling fluid, typically cooling air, distribution element as described above has several advantages.

First of all, the directional fins make it possible to better distribute the "fresh" air supply and therefore to homogeneously cool the wall to be cooled, for example the ring sector placed downstream of the flow. Then, the cooling air being better channeled, the unnecessary recirculation and pressure losses as well as the associated heating of the cooling gas are limited. Finally, by also acting as construction pillars, the fins considerably simplify the manufacturing method by offering several possible construction orientations (therefore geometries) and by limiting the post-melting operations, in particular because there are no more supports to remove during the construction of the internal volume according to a powder bed laser melting process.

Preferably, said body has a substantially pyramidal shape, a base of which is intended to accommodate said multi-perforated plate including said outlet through-perforations diffusing the cooling fluid and whose inclined faces meet at the top at the level of said cooling air inlet orifice.

Advantageously, said directional fins are evenly distributed inside said internal volume.

Preferably, said directional fins include respective tops forming a vault providing support for a ceiling surface of said internal volume.

Advantageously, said directional fins include a central fin disposed in a central axis passing through the axis of said inlet orifice, at least two other fins being identically distributed on either side of said central fin with angles of inclination $\alpha$ and $\beta$ with respect to said increasing central axis.

Preferably, said first fin is inclined with respect to said central axis in a range comprised between 30 and 44° and said second fin is inclined with respect to said central axis in a range comprised between 45 and 59°.

Advantageously, said directional fins are in a number comprised between 3 and 9.

The present invention also relates to a turbine ring assembly comprising a plurality of ring sectors forming a turbine ring, a ring support structure and a plurality of distribution elements as mentioned above, as well as a turbomachine comprising such a turbine ring assembly.

The invention also relates to a powder bed laser melting process for the manufacture of a distribution element as mentioned above, wherein said directional fins act as a permanent support during the construction of said internal volume.

BRIEF DESCRIPTION OF THE DRAWINGS

Other characteristics and advantages of the invention will emerge from the following description of particular embodiments of the invention, given by way of non-limiting examples, with reference to the appended drawings, wherein.

DETAILED DESCRIPTION OF EMBODIMENTS

Figure 1:
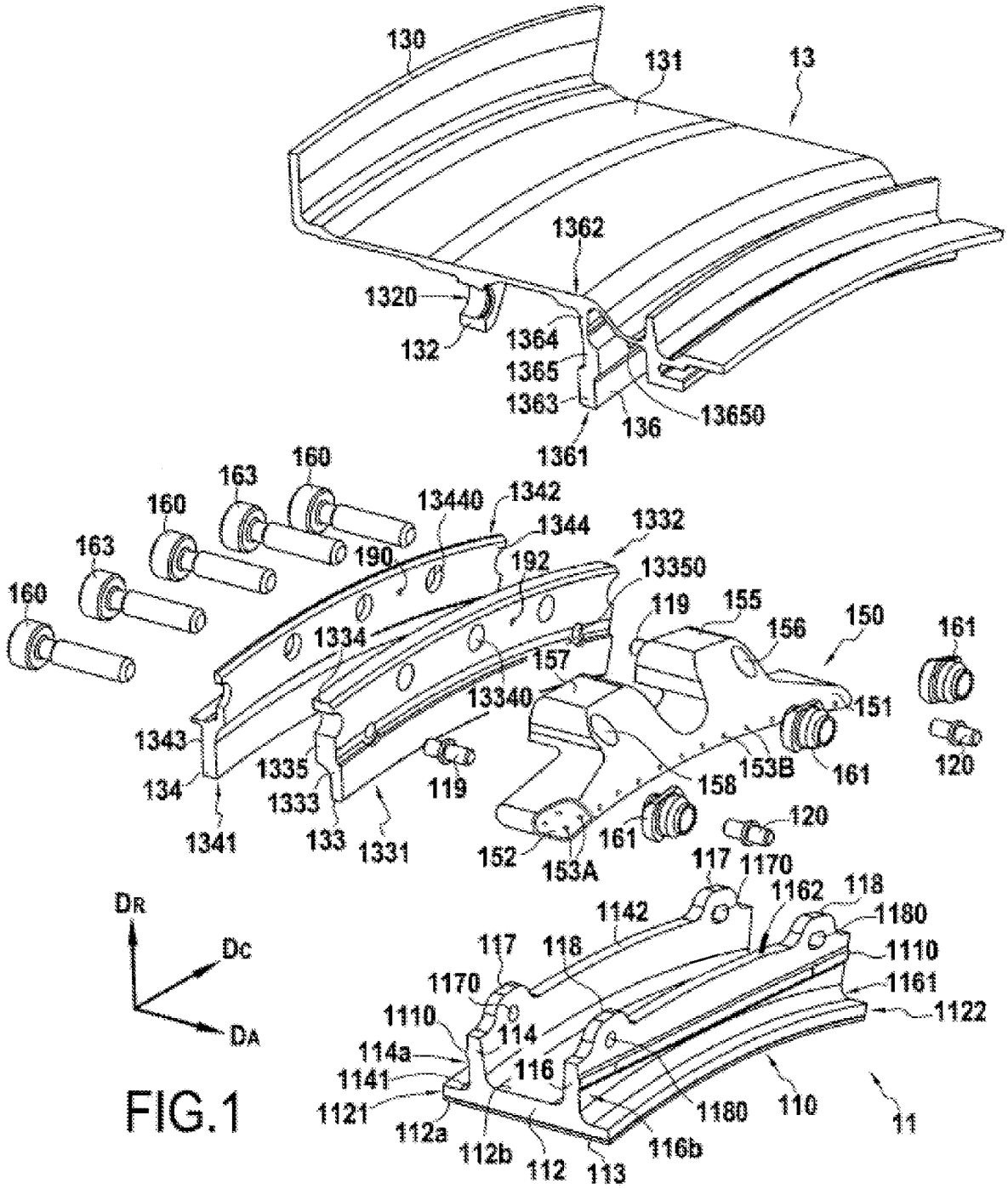
FIG. 1 is a schematic exploded perspective view of a turbine ring assembly integrating a cooling fluid distribution element according to the invention.

FIG. 1 presents a schematic exploded perspective view of a portion of a high-pressure turbine ring assembly comprising a turbine ring 11 made of ceramic matrix composite (CMC) material or of metal material and a metal ring support structure 13. When the ring 11 is made of CMC material, the ring support structure 13 is made of a material having a coefficient of thermal expansion greater than the coefficient of thermal expansion of the material constituting the ring sectors. The turbine ring 11 surrounds a set of rotary vanes (not represented) and is formed by a plurality of ring sectors 110. The arrow $D_A$ indicates the axial direction of the turbine ring 11 while the arrow $D_R$ indicates the radial direction of the turbine ring 11. The arrow $D_C$ indicates for its part the circumferential direction of the turbine ring.

Each ring sector 110 has, according to a plane defined by the axial $D_A$ and radial $D_R$ directions, a section substantially in the form of the inverted Greek letter π. The sector 110 indeed comprises an annular base 112 and upstream and downstream radial attachment tabs 114 and 116. The terms "upstream" and "downstream" are used here with reference to the flow direction of the gas stream in the turbine which takes place along the axial direction $D_A$.

The annular base 112 includes, along the radial direction $D_R$ of the ring 11, an inner face 112*a* and an outer face 112*b* opposite each other. The inner face 112*a* of the annular base 112 is coated with a layer 113 of abradable material forming a thermal and environmental barrier and defines a gas stream flowpath in the turbine.

The upstream and downstream radial attachment tabs 114 and 116 protrude, along the direction $D_R$, from the outer face 112*b* of the annular base 112 at a distance from the upstream and downstream ends 1121 and 1122 of the annular base 112. The upstream and downstream radial attachment tabs 114 and 116 extend over the entire circumferential length of the ring sector 110 that is to say over the entire arc of a circle described by the ring sector 110.

The ring support structure 13 which is secured to a turbine casing 130 comprises a central crown 131, extending in the axial direction $D_A$, and having an axis of revolution coincident with the axis of revolution of the ring turbine 11 when they are fixed together. The ring support structure 13 further comprises an upstream annular radial clamp 132 and a downstream annular radial clamp 136 which extend, along the radial direction $D_R$, from the central crown 31 towards the center of the ring 11 and in the circumferential direction of the ring 11.

The downstream annular radial clamp 136 comprises a first free end 1361 and a second end 1362 secured to the central crown 131. The downstream annular radial clamp 136 includes a first portion 1363, a second portion 1364 and a third portion 1365 comprised between the first portion 1363 and the second portion 1364. The first portion 1363 extends between the first end 1361 and the third portion 1365, and the second portion 1364 extends between the third portion 1365 and the second end 1362. The first portion 1363 of the annular radial clamp 136 is in contact with the downstream radial attachment tab 116. The second portion 1364 is thinned relative to the first portion 1363 and the third portion 1365 so as to provide some flexibility to the annular radial clamp 136 and thus not to greatly stress the turbine ring 11.

The ring support structure 13 also comprises a first and a second upstream flange 133 and 134 each having, in the example illustrated, an annular shape. The two upstream flanges 133 and 134 are fixed together on the upstream annular radial clamp 132. As a variant, the first and second upstream flanges 133 and 134 could be segmented into a plurality of ring sections.

The first upstream flange 133 comprises a first free end 1331 and a second end 1332 in contact with the central crown 131. The first upstream flange 133 further comprises a first portion 1333 extending from the first end 1331, a second portion 1334 extending from the second end 1332, and a third portion 1335 extending between the first portion 1333 and the second portion 1334.

The second upstream flange 134 comprises a first free end 1341 and a second end 1342 in contact with the central crown 131, as well as a first portion 1343 and a second portion 1344, the first portion 1343 extending between the first end 1341 and the second portion 1344, and the second portion 1344 extending between the first portion 1343 and the second end 1342.

The first portion 1333 of the first upstream flange 133 is bearing on the upstream radial attachment tab 114 of the ring sector 110. The first and second upstream flanges 133 and 134 are shaped to have the first portions 1333 and 1343 distant from each other and the second portions 1334 and 1344 in contact with each other, the two flanges 133 and 134 being removably fixed on the upstream annular radial clamp 132 by means of fixing screws 160 and nuts 161, the screws 160 passing through orifices 13340, 13440 and 1320 provided respectively in the second portions 1334 and 1344 of the two upstream flanges 133 and 134 as well as in the upstream annular radial clamp 132. The nuts 161 are for their part secured to the ring support structure 13, being for example fixed by crimping thereto.

The second upstream flange 134 is dedicated to take up the force of the high-pressure distributor (DHP), on the one hand, by deforming and, on the other hand, by passing this force towards the casing line which is more robust mechanically, that is to say towards the line of the ring support structure 13.

In the axial direction $D_A$, the downstream annular radial clamp 136 of the ring support structure 13 is separated from the first upstream flange 133 by a distance corresponding to the spacing of the upstream and downstream radial attachment tabs 114 and 116 so as to maintain them between the downstream annular radial clamp 136 and the first upstream flange 133. It is possible to carry out an axial pre-stressing of the clamp 136. This allows taking up the expansion differences between the metal elements and the CMC ring sectors when these are used.

To further hold in position the ring sectors 110, and therefore the turbine ring 11, with the ring support structure 13, the ring assembly comprises, in the example illustrated, two first pins 119 cooperating with the upstream attachment tab 114 and the first upstream flange 133, and two second pins 120 cooperating with the downstream attachment tab 116 and the downstream annular radial clamp 136.

For each corresponding ring sector 110, the third portion 1335 of the first upstream flange 133 comprises two orifices 13350 for accommodating the first two pins 119, and the third portion 1365 of the annular radial clamp 136 comprises two orifices 13650 configured to accommodate the two second pins 120.

For each ring sector 110, each of the upstream and downstream radial attachment tabs 114 and 116 comprises a first end 1141 and 1161, secured to the outer face 112*b* of the annular base 112 and a free second end 1142 and 1162. The second end 1142 of the upstream radial attachment tab 114 comprises two first lugs 117 each including an orifice 1170 configured to accommodate a first pin 119. Similarly, the second end 1162 of the downstream radial attachment tab 116 comprises two second lugs 118 each including an orifice 1180 configured to accommodate a second pin 120. The first and second lugs 117 and 118 protrude in the radial direction $D_R$ of the turbine ring 11 respectively of the second end 1142 of the upstream radial attachment tab 114 and of the second end 1162 of the downstream radial attachment tab 116.

For each ring sector 110, the two first lugs 117 are positioned at two different angular positions with respect to the axis of revolution of the turbine ring 11. Similarly, for each ring sector 110, the two second lugs 118 are positioned at two different angular positions with respect to the axis of revolution of the turbine ring 11.

Each ring sector 110 further comprises rectilinear bearing surfaces 1110 mounted on the faces of the upstream and downstream radial attachment tabs 114 and 116 in contact respectively with the first upstream annular flange 133 and the downstream annular radial clamp 136, that is to say on the upstream face 114*a* of the upstream radial attachment tab 114 and on the downstream face 116*b* of the downstream radial attachment tab 116. As a variant, the rectilinear bearings could be mounted on the first upstream annular flange 133 and on the downstream annular radial clamp 136.

The rectilinear bearings 1110 allow having controlled sealing areas. Indeed, the bearing surfaces 1110 between the upstream radial attachment tab 114 and the first upstream annular flange 133, on the one hand, and between the downstream radial attachment tab 116 and the downstream annular radial clamp 136, on the one hand, are comprised in the same rectilinear plane.

More precisely, having bearings on radial planes allows overcoming the effects of de-cambering in the turbine ring 11. Furthermore, the rings in operation tilt around a normal to the plane ($D_A$, $D_R$). A curvilinear bearing would generate contact between the ring 11 and the ring support structure 13 at one or two points. Conversely, a rectilinear bearing allows a bearing on a line.

According to the invention, the ring assembly further comprises, for each ring sector 110, a cooling fluid distribution element 150. This distribution element 150 constitutes a fluid (typically air) diffuser allowing the impact of a cooling stream $F_R$ on the outer face 112*b* of the ring sector 110 (see FIG. 3). The element 150 is present in the space delimited between the turbine ring 11 and the ring support structure 13 and more particularly between the first upstream annular flange 133, the central crown 131 and the upstream and downstream radial attachment tabs 114 and 116. The distribution element 150 comprises a hollow body 151 which defines a cooling air distribution internal volume as well as a multi-perforated plate 152 which delimits this internal volume and comprises a plurality of outlet through-perforations 153A which put the internal volume of the hollow body 151 into communication with the space opposite the outer face 112*b* of the ring sector 110.

Figure 3:
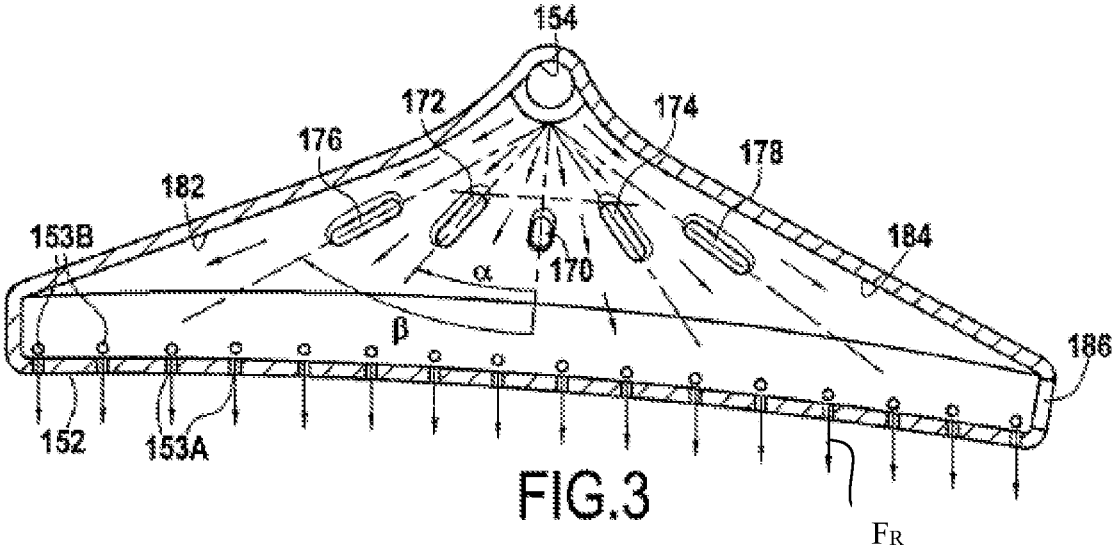
FIG. 3 is a partial sectional view of the cooling fluid distribution element of FIG. 1.

The hollow body 151 advantageously has a substantially pyramidal shape (that is to say progressive with a narrower inlet than the outlet) whose base is intended to accommodate the multi-perforated plate 152 including the radial outlet through-perforations 153A and whose inclined faces meet at the top at the level of an axial cooling air inlet orifice 154 (illustrated in FIG. 3).

The multi-perforated plate 152 is located opposite (facing) the outer face 112*b* of the ring sector 110 and has, in the example illustrated, an elongated shape along the circumferential direction $D_C$ of the turbine ring 11. The multi-perforated plate 152 also includes a plurality of lateral outlet through-perforations 153B which opens between the first 114 and second 116 attachment tabs of the ring sector 110. No third parties is present between the multi-perforated plate 152 and the outer face 112*b* of the ring sector 110 or the first 114 and second 116 attachment tabs so as not to slow down or disturb the flow of the cooling air passing through the plate 152 and impacting the ring sector 110. The multi-perforated plate 152 which delimits the internal volume of the hollow body 151 is located on the side of the ring sector 110 (radially inwardly). The distribution element 150 further comprises a portion for guiding the cooling air 155 which extends from the body 151 both in the radial direction $D_R$ and in the axial direction $D_A$. The guide portion 155 is positioned radially outwardly relative to the multi-perforated plate 152. This guide portion 155 defines an internal channel (illustrated by the inlet orifice 154 in FIG. 3 which defines its outlet) which is in communication with the cooling air supply orifices 192 and 190 respectively arranged in the first 133 and second 134 upstream flanges.

The cooling air stream $F_R$ taken upstream from the turbine is intended to pass through the orifices 190 and 192 for being conveyed to the ring sector 110. The guide portion 155 defines the internal channel through which the cooling air stream $F_R$ is intended to pass for being transferred to the internal volume of the hollow body 151 and distributed to the ring sector 110 following its passage through the multi-perforated plate 152. The internal channel has an inlet orifice (not visible in the figure) which is preferably located opposite (facing and in contact) or in the extension (that is to say very closely spaced from the first upstream flange 133) of the supply orifice 192 and communicating with the latter. The internal channel also opens into the internal volume through the inlet orifice 154 which emerges at the top of the pyramidal volume 151 at an end opposite to the multi-perforated plate 152. The internal channel of the guide portion 155 has the role of channeling the cooling air $F_R$ arriving through the orifice 192 in order to transfer it into the internal volume then towards the ring sector 110 and thus minimize the losses or leaks of this cooling air.

Figure 2:
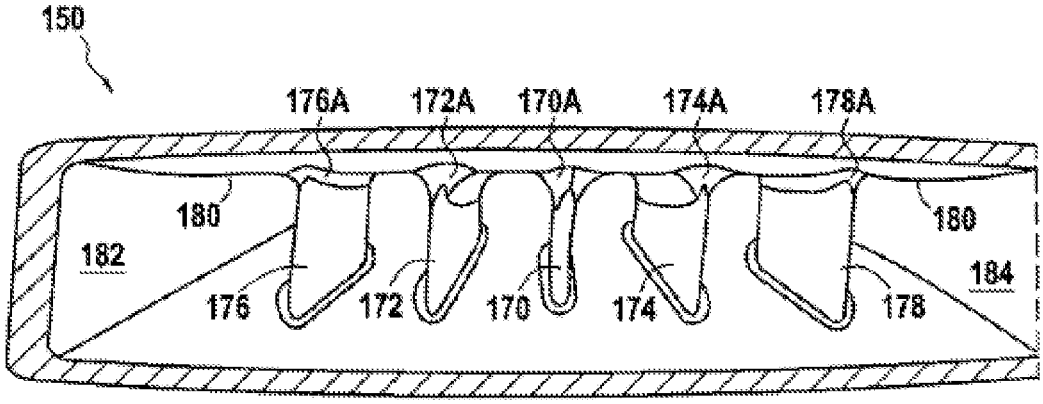
FIG. 2 is an end view, with removed multi-perforated plate, of the cooling fluid distribution element of FIG. 1.

In order to ensure homogeneous cooling of the ring sector 110 and as illustrated in FIGS. 2 and 3, the internal pyramidal volume includes directional fins 170, 172, 174, 176, 178, evenly distributed inside this volume and also acting as permanent manufacturing supports (pillars) allowing the construction of the ceiling surface 180, the lateral faces 182, 184 of the internal volume contributing, just like the pillars, to guide the cooling air stream and to maintain the ceiling surface during this construction.

Thus, the respective tops 170A, 172A, 174A, 176A, 178A of the fins form a "vault" ensuring the support for the ceiling surface 180 for which the conventional supporting solutions do not work with such an area inaccessible from outside. The pillars and the vault they form at their top thus offer a permanent supporting solution more efficient than the conventional generic supports in terms of mass and aerodynamic performance and furthermore making the geometry fully compatible with a powder bed laser melting process.

In addition, by specifying individually each cooling hole (different sections of surface hole, straight micro-perforation, with chamfer or with fillet, round, diamond section or the like, axis of holes orthogonal or inclined relative to the surface, distribution of position of holes adjusted periodically or the like) in any area of the part (in a planar area as in its lateral portions (fillets), a better distribution of the flow of fresh air used to cool and homogenize the temperature of the downstream ring sector is ensured. The directional fins allow better distributing the "fresh" air supply and therefore homogeneously cooling the ring sector placed downstream of the flow. More particularly, the central fin 170 is disposed in a central axis passing through the axis of the inlet orifice 154 substantially equidistant from this orifice and from the multi-perforated plate 152. The other fins are distributed identically on either side of this central fin preferably with angles of inclination $\alpha$ and $\beta$ with respect to the increasing central axis by approaching the lateral faces 182, 184. Thus, on either side of this central fin 170, is disposed a first fin 172, 174 inclined with respect to the central axis in a range comprised between 30° and 44° and a second fin 176, 178 inclined in a range comprised between 45° and 59°.

Note that if these fins have been defined by a single angle, and can therefore be qualified as straight fins, it is of course possible, depending on the desired air stream deviation, to make a more complex geometry, specific to the image of turbine vanes with inclinations and curvatures having a different angle upstream and downstream. Similarly, depending on the desired uniform or non-uniform air distribution, the central fin may or may not be present. Of course, the number of directional fins cannot be limiting and is advantageously comprised between 3 and 9.

The guide portion 155 also defines a through-housing 156, in this case, but which could alternatively be blind and whose fixing screw 163 intended to cooperate with this housing 156 ensures fixing the distribution element 150 to the ring support structure 13. As can be seen particularly in FIG. 1, the distribution element 150 comprises, in the example illustrated, an additional holding portion 157 distinct from the guide portion 155 (the portion 157 not necessarily having an internal channel for conveying the cooling fluid which must then pass through an inner wall 186 open between these two portions). The portions 155 and 157 of the same distribution element 150 are offset along the circumferential direction $D_C$. The holding portion 157 also defines a housing 158 cooperating with a fixing screw 163 in order to allow fixing the element 150 to the ring support structure 13. In the example illustrated, the fixing screws 163 extend along the axial direction $D_A$ of the turbine ring and pass through the first 133 and second 134 upstream flanges when they are housed in the housings 156 and 158.

A method for producing a turbine ring assembly corresponding to that represented in FIG. 1 is now described.

When the ring sectors 110 are made of CMC material, they are produced by formation of a fibrous preform having a shape close to that of the ring sector and densification of the ring sector by a ceramic matrix.

For the production of the fibrous preform, it is possible to use ceramic fiber yarns, for example SiC fiber yarns such as those marketed by the Japanese company Nippon Carbon under the name HI-NICALONS' (which is a silicon carbide continuous fiber that possesses high strength, heat and corrosion resistance even in a high temperature air atmosphere over one thousand degree) or carbon fiber yarns.

The fibrous preform is advantageously made by three-dimensional weaving, or multi-layer weaving with the arrangement of non-interlinked areas making it possible to space apart the portions of preforms corresponding to the tabs 114 and 116 of the sectors 110.

The weaving can be of the interlock type, as illustrated. Other weaves of three-dimensional or multilayer weaving can be used such as for example multi-plain or multi-satin weaves. Reference may be made to document WO 2006/136755.

After weaving, the blank can be shaped to obtain a ring sector preform which is consolidated and densified by a ceramic matrix, densification being able to be achieved in particular by gas-phase chemical infiltration (CVI) which is well known per se. As a variant, the textile preform can be a little cured by CVI so that it is rigid enough to be manipulated, before raising liquid silicon by capillarity in the textile for carrying out the densification.

A detailed example of manufacture of CMC ring sectors is in particular described in document US 2012/0027572.

When the ring sectors 110 are made of metal material, they can for example be formed by one of the following materials: AM1 alloy (a nickel base alloy), C263® alloy (an aluminum-titanium age hardening nickel alloy) or M509 alloy (a cobalt base alloy).

The ring support structure 13 is for its part made of a metal material such as a Waspaloy® or Inconel® 718 or even C263® alloy.

Figure 4:
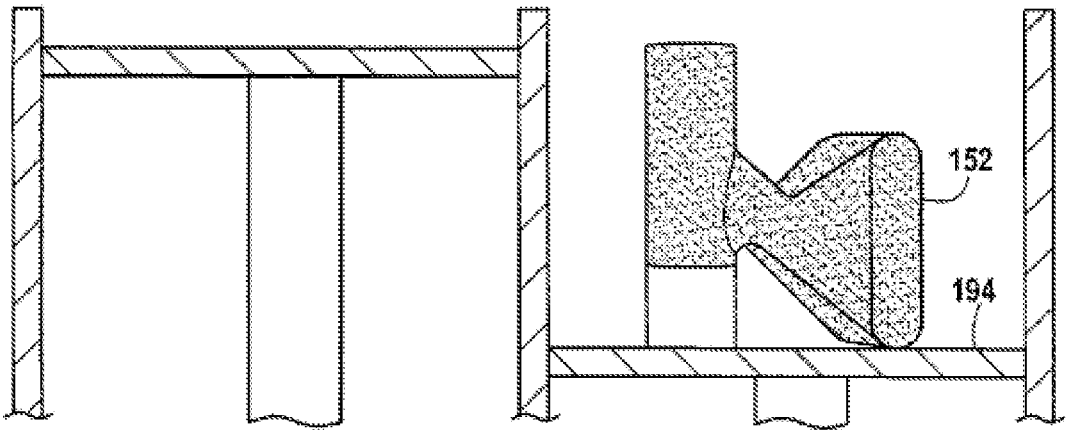
FIG. 4 illustrates an example of a device allowing the production of a distribution element.

As shown in FIG. 4, the distribution element 150 is advantageously produced by a powder bed laser melting process (LBM for Laser Beam Melting) which guarantees better geometric accuracy and a reduction in the air gap with the ring due to a one-piece design. The LBM process, by reducing the overall volume of supports, the surfaces to take up in machining, or even the space requirement on the manufacturing table, allows obtaining a significant reduction in the manufacturing costs by a decrease in the mass (small thickness) while bringing an improvement in terms of performance (cooling, lightness).

By vertical positioning of the perforated wall 152 on the manufacturing table 194, better control of its geometry is ensured while reducing its roughness level (both mechanical and aerodynamic benefit). Furthermore, by making the construction pillars operational and permanent (1 fin=1 construction pillar), a geometry is thus created which optimizes the cooling function while supporting the ceiling surface, thus ensuring better manufacturability without penalizing the mass.

The production of the turbine ring assembly continues with the mounting of the ring sectors 110 on the ring support structure 13. This mounting can be performed ring sector by ring sector as follows.

The first pins 119 are first placed in the orifices 13350 provided in the third portion 1335 of the first upstream flange 133, and the ring sector 110 is mounted on the first upstream flange 133 by engaging the first pins 119 in the orifices 1170 of the first lugs of the upstream attachment tab 114 until the first portion 1333 of the first upstream flange 133 bears against the bearing surface 1110 of the upstream face 114*a* of the upstream attachment tab 114 of the ring sector 110.

The second upstream flange 134 is then fixed to the first upstream flange 133 and to the distribution element 150 present between the tabs 114 and 116 by positioning the fixing screws 163 through the orifices 13440, 13340, 154 and 158.

Then the two second pins 120 are inserted into the two orifices 13650 provided in the third portion 1365 of the annular radial clamp 136 of the ring support structure 13.

The assembly comprising the ring sector 110, the flanges 133 and 134 and the distribution element 150 previously obtained is then mounted on the ring support structure 13 by inserting each second pin 120 in each of the orifices 1180 of the second lugs 118 of the downstream radial attachment tabs 116 of the ring sector 110. During this mounting, the second portion 1334 of the first upstream flange 133 is put in abutment against the upstream annular radial clamp 132.

The mounting of the ring sector is then completed by inserting the fixing screws 160 into the still free orifices 13440, 13340 and coaxial orifices 1320, and each of the screws is then tightened in the nuts 161 secured to the ring support structure.

The exemplary embodiment which has just been described comprises, for each ring sector 110, two first pins 119 and two second pins 120, without however departing from the scope of the invention if for each ring sector, two first pins 119 and a single second pin 120 or a single first pin 119 and two second pins 120 are used.

In a variant not illustrated, it is also possible to use a distribution element 150 having the same structure as the one described in FIG. 1 and pins extending in the radial direction between the central crown 131 and the attachment tabs 114 and 116 in order to hold these tabs in a radial position. According to this variant, the ends of these pins are forcibly inserted into orifices made in the central crown 131 in order to ensure their maintenance. As a variant, these pins could be mounted with a clearance in the orifices of the central crown 131 and then be welded thereafter.

It will be noted that if the description above has primarily focused on a distribution element for turbine ring sectors, it is clear that such a shower-type distribution element can also find application in all other engine members, for example walls or surfaces to be cooled, requiring a cooling air supply such as a casing.

The invention claimed is:

1. A cooling fluid distribution element intended to be fixed to a support structure for supplying cooling fluid to a wall to be cooled facing said cooling fluid distribution element, said cooling fluid distribution element comprising:

a body defining a cooling fluid distribution internal volume;

a multi-perforated plate which delimits said cooling fluid distribution internal volume and comprises a plurality of outlet through-perforations which put said cooling fluid distribution internal volume into communication with said wall to be cooled, and an inlet orifice opening into said cooling fluid distribution internal volume, wherein said cooling fluid distribution internal volume includes directional fins evenly distributed inside said cooling fluid distribution internal volume between two lateral faces of said cooling fluid distribution internal volume and supporting a ceiling surface joining said two lateral faces, for directing said cooling fluid from said inlet orifice to said plurality of outlet through-perforations, and wherein said directional fins include a central fin disposed in a central axis passing through an axis of said inlet orifice, equidistant from said inlet orifice and from said multi-perforated plate, and at least two other fins that are identically distributed on either side of said central fin with increasing angles of inclination $\alpha$ and $\beta$ with respect to said central axis.

2. The cooling fluid distribution element according to claim 1, wherein said body has a pyramidal shape comprising a base and two inclined faces, the base accommodates said multi-perforated plate including said plurality of outlet through-perforations diffusing said cooling fluid and, where the two inclined faces meet at a top at a level of said inlet orifice.

3. The cooling fluid distribution element according to claim 1, wherein said directional fins include respective tops forming a vault providing support for the ceiling surface of said cooling fluid distribution internal volume.

4. The cooling fluid distribution element according to claim 1, wherein a first fin of the at least two other fins is inclined with respect to said central axis at said angle of inclination $\alpha$ that is in a range comprised between 30° and 44° and a second fin of the at least two other fins is inclined with respect to said central axis at said angle of inclination $\beta$ that is in a range comprised between 45° and 59°.

5. The cooling fluid distribution element according to claim 1, wherein said directional fins are in a number comprised between 3 and 9.

6. A turbine ring assembly for a turbomachine comprising a plurality of ring sectors forming a turbine ring, a ring support structure and a plurality of the cooling fluid distribution element according to claim 1.

7. A turbomachine comprising the turbine ring assembly according to claim 6.

8. A powder bed laser melting process for manufacture of the cooling fluid distribution element according to claim 1, wherein said directional fins act as a permanent support during construction of said cooling fluid distribution internal volume.

* * * * *